United States Patent [19]

Schneible

[11] 3,939,788

[45] Feb. 24, 1976

[54] METHOD OF MAKING A SAFETY CLOSURE FOR A CONTAINER

[75] Inventor: Seth R. Schneible, South Salem, N.Y.

[73] Assignee: Eyelet Specialty Co., Inc., Wallingford, Conn.

[22] Filed: Nov. 11, 1974

[21] Appl. No.: 522,890

Related U.S. Application Data

[62] Division of Ser. No. 414,448, Nov. 9, 1973, Pat. No. 3,892,326.

[52] U.S. Cl. ..... 113/121 A; 215/216

[51] Int. Cl.[2] ..... B65D 55/02

[58] Field of Search ..... 113/121 C, 121 AA, 1.1 E, 113/121 A, 121 E; 215/216, 220, 9

[56] References Cited

UNITED STATES PATENTS

| | | | |
|---|---|---|---|
| 2,155,274 | 4/1939 | Kenah | 113/121 E UX |
| 3,510,021 | 5/1970 | Silver | 215/216 X |
| 3,744,655 | 7/1973 | Nixdorff, Jr. | 215/216 |
| 3,797,688 | 3/1974 | Porcelli et al. | 215/9 |
| 3,817,416 | 6/1974 | Costa | 215/9 |

*Primary Examiner*—Milton S. Mehr

*Attorney, Agent, or Firm*—Hopgood, Calimafde, Kalil, Blaustein & Lieberman

[57] ABSTRACT

The invention contemplates a method of making a child-resistant safety cap, locking ring and container-neck combination, wherein the container may be formed of multiple metal parts, wherein the locking ring is assembled to the neck, and wherein the cap has a threaded engagement to the neck, with releasable ratcheting one-way engagement between the cap and the ring, in approach to the closed relation of the parts. The particular feature of the invention resides in the manner in which a resilient plastic locking ring is assembled to the neck part of the container in axially located and angularly keyed relation to the neck part.

5 Claims, 7 Drawing Figures

Fig.1.
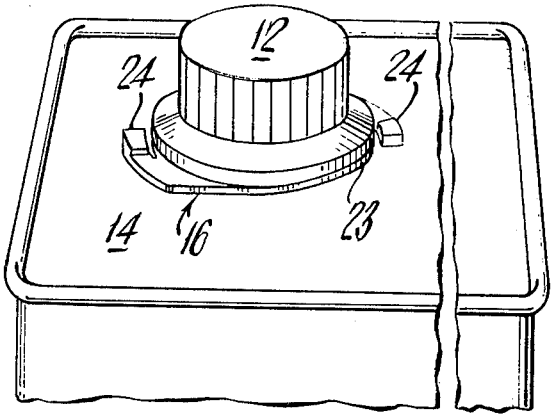
Fig.2.
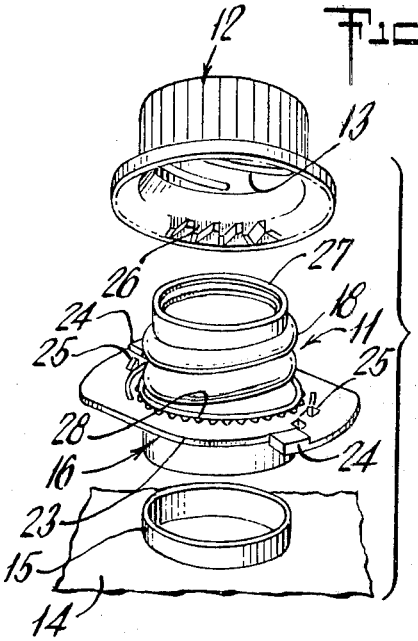
Fig.4.
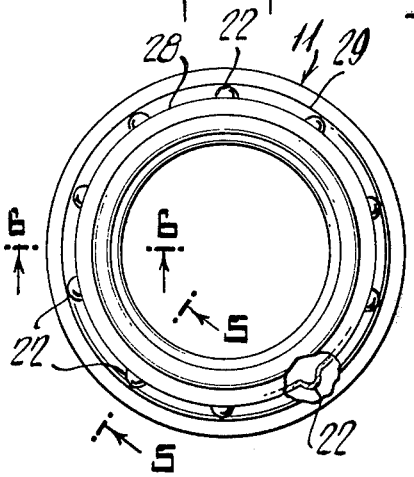
Fig.5.
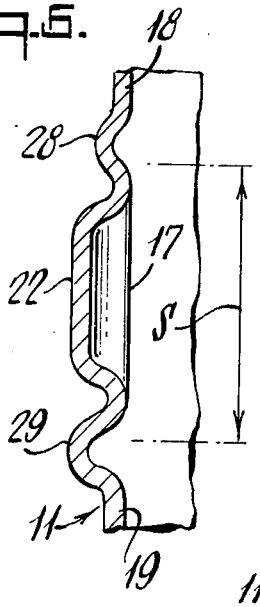
Fig.6.
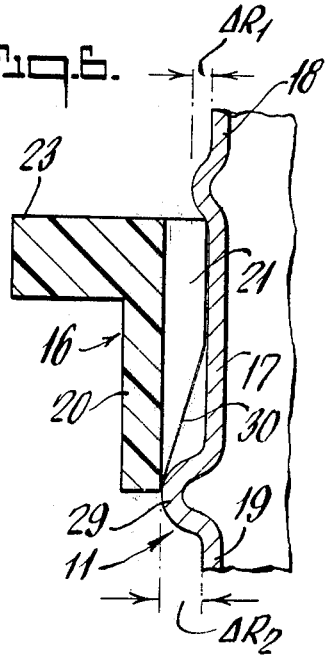
Fig.3.
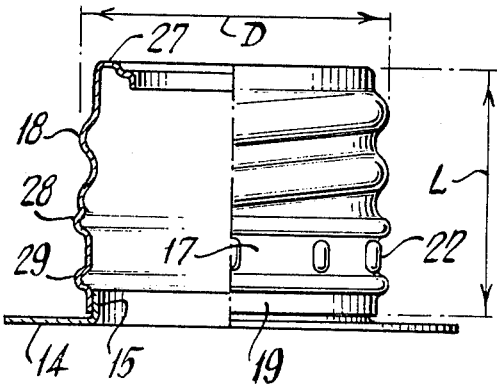
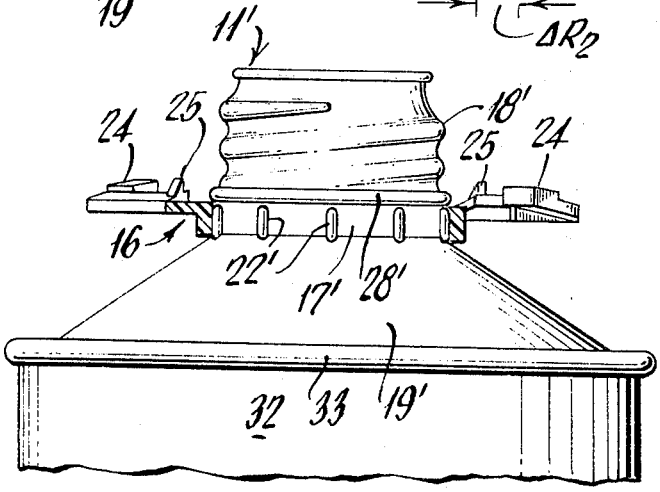
Fig.7.

METHOD OF MAKING A SAFETY CLOSURE FOR A CONTAINER

This application is a division of my co-pending application, Ser. No. 414,448, filed Nov. 9, 1973 (now U.S. Pat. No. 3,892,326, issued July 1, 1975).

This invention relates to metal containers adapted to contain hazardous substances, and more particularly relates to the construction of such containers so that they may accept safety closures which render the container child-resistant, i.e., resistant to tampering by children.

It is an object of this invention to provide a new and improved container construction, with a child-resistant safety-cap feature, particularly of the variety having rotary engagement, as by threads.

Another object of the invention is to provide a new metal container construction with such a safety feature, such construction being economical to manufacture and readily lending itself to automatic production-line facilities for filling and capping the container.

A still further object is to meet the above objects with a construction of inherent low cost, involving minimum alteration of present constructions.

Other objects and various further features of novelty and invention will be pointed out or will occur to those skilled in the art from a reading of the following specification in conjunction with the accompanying drawings. In said drawings, which show, for illustrative purposes only, preferred forms of the invention:

FIG. 1 is a fragmentary perspective view of a closed metal container of the invention, with contents sealed by a closure of the character indicated;

FIG. 2 is an exploded perspective view of the parts of FIG. 1, the cap being tilted up for a better showing of detail;

FIG. 3 is a side view, partly broken-away and in longitudinal section, to show the container-neck part of FIG. 1;

FIG. 4 is a plan view of the part of FIG. 3;

FIGS. 5 and 6 are enlarged vertical sectional views of portions of the part of FIGS. 3 and 4, taken respectively at sections 5—5 and 6—6 of FIG. 4; and FIG. 7 is a fragmentary view, partly broken-away and in longitudinal section, to illustrate a modification.

Referring to FIGS. 1 to 6, the invention is shown in application to a multiple-part metal container having a threaded neck part 11 and selectively opened and closed by a cap 12 having a threaded bore 13. The container may be one of a variety of styles and constructions, and is shown as generally rectangularly prismatic, with an upper-end body part of panel 14 having a short cylindrical flange 15 struck up from panel 14 at the location of a dispensing opening therein. Cap 12 may be of any suitable construction, being typically an injection-molded plastic part.

The neck part 11 non-rotatably carries a locking ring 16 in the intermediate region 17 between the threaded region 18 and the base-end or container-attachment portion 19 of said ring part; as suggested by sectioning in FIG. 6, ring 16 is of suitable plastic, preferably injection-molded, and is proportioned for relatively stiffly compliant yieldability, for the deflections and transient deformations described below. The ring 16 may be of the type more fully discussed and disclosed in pending Landen Application, Ser. No. 351,266, filed Apr. 16, 1973, now U.S. Pat. No. 3,844,379. Briefly, it suffices here to indicate that such a ring 16 includes a cylindrical body 20 with a bore characterized as by spline teeth 21 for anti-rotational engagement with one or more key formations 22 in the neck part 11; the spacing between ribs 22 is preferably an integer multiple of the pitch interval of the spline teeth 21. Peripheral-flange formations 23 terminate in substantially diametrically opposite axially compliant tabs 24 which extend radially outward for manual actuation, by downward depression to release an applied cap 12. Ratchet lugs 25 on the upper surface of tabs 24 have one-way ratcheting engagement with ratchet-tooth formations 26 in the bore 13 of cap 12, the relation of these formations being such as to permit escaping ratchet action as the cap approaches its full threaded advance on the threaded portion 18 of the neck part 11.

The neck and body parts 11-14 are intentionally patterned closely on existing practice in the metal container art. For example, the neck part 11 may be of overall length L and diameter D corresponding to a conventional neck part; and the attachment region 19 may be a short cylindrical sleeve for telescoping fit over the body flange 15, the same being permanently and circumferentially continuously secured by soldering at the region of telescopic overlap. In accordance with the invention, the intermediate region 17 in neck part 11 and the bore of ring 16 are particularly characterized for simple and accurate assembly, at a point in time after the soldering operation has assembled the container parts 11-14.

The neck part 11 is initially a straight cylindrical tube into which the threads 18 and lip 27 are rolled or otherwise formed. These operations may remain the same, in practicing the invention, in that the axial-locating and keying formations may be subsequent operations on otherwise conventionally formed neck parts; it will also be understood that all forming operations can be automatically performed, in a single machine and at the same time, if desired.

As shown, the axial-locating means comprises an upper circumferentially continuous bead or outward projection 28 near the lower end of threaded portion 18, and a lower circumferentially continuous bead or outward projection 29 near the upper end of attachment portion 19. The incremental radius or extent $\Delta R_1$ of outward projection of bead 28 is less than that ($\Delta R_2$) of bead 29, the relationship of $\Delta R_2$ to $\Delta R_1$ being preferably in the order of 2:1, as shown, and the effective axial separation S between beads 28-29 is substantially the axial extent of the ring body 20. The keying formations 22 between beads 28-29 are shown as angularly spaced, longitudinally extending, outward projections or ribs, the same being rounded or otherwise formed to engage between spline teeth 21 in the bore of ring 16; preferably, ribs 22 extend outwardly to substantially the same extent as the lower bead 29, as shown in FIG. 5.

To coact with the described neck-part formations, the spline teeth 21 are of radial depth substantially that of the lower bead 29, and the lower ends of teeth 21 are conically truncated or otherwise tapered, as shown at 30 in FIG. 6. The extent of this taper is such as to reliably locate on bead 28 in the course of axial assembly, the taper 30 providing radially outward cam action as ring 16 is transiently and compliantly deformed in its progress past bead 28. Once past bead 28, the lower end of ring 16 is axially located by bead 29 and the upper end snaps into location beneath bead 28. The splines 21 engage lugs 22 in the course of such assembly, the location being completed upon the indicated snap-in action.

It will be seen that the described construction lends itself to low-cost realization of all stated objects, using to the maximum extent parts and techniques which are current and readily available. Ring assembly to preassembled container body and neck parts is a simple automated procedure and may if desired be performed at the same time as automated application of the cap 12 is made. In other words, rotation and axial advance of a tool which simultaneously assembles a ring 16 and its cap 12 will assure against fouling the keyed engagement 21-22, thereby ensuring proper ring location, followed by complete threaded advance of cap 12 to its ratchet-locked position. Also, the threaded advance of the cap 12 may be utilized to axially drive the ring 16 into its keyed detent-retained position.

FIG. 7 illustrates a modification wherein the principle of the invention is applied to another metal-container construction, wherein the neck part 11' includes threaded and intermediate regions 18'-17' as already described, but wherein the attachment region 19' is characterized by a frusto-conical outward flare to the diameter of an upwardly open cylindrical body part 32. Container construction is completed by the usual chime connection 33 between parts 19'-32. Since the base end 19' flares outwardly from the intermediate region 17', there is no need for a lower bead 29, but the upper bead 28' and keying ribs 22' will be understood to have the same relationship with splines 21 and ring 16 as already described, the lower limit of axial retention being determined by flared portion 19'.

It will be appreciated that the construction of FIG. 7 lends itself to various methods of assembly, depending upon the nature of the particular material contents of and filling devices for the container. For example, cap 12, ring 16, and the neck part 11' may be a complete preassembly, the same being assembled by chime connection 33 after the container-body part 32 has been filled. Alternatively, parts 11'-32 may be preassembled at chime 33, so that filling is via the opening in neck 11', the ring 16 and cap 12 being thereafter applied. Still further, alternatively, the cylindrical body 32 may have an open bottom, to be later closed by a chimed connection to a bottom-end panel (not shown); in this event, the cylindrical (open-bottom) body part 32, chime-connected to neck part 11', and with ring 16 and cap 12 applied, may all be a subassembly adapted for bottom filling, the container being completed and sealed by the bottomchime connection to the bottom end panel.

While the invention has been described in detail for the preferred forms shown, it will be understood that modifications may be made without departure from the claimed invention.

What is claimed is:

1. The method of making a self-locking safety closure for a metal container having a threaded neck to be closed by a threaded cap, which comprises selecting a threaded metal neck part and a container-body part to be assembled to each other, forming the neck part with threads at a region predominantly near the dispensing end and with means for attachment to the selected container-body part at a region near the other end, the thread and attachment regions being axially separated by an intermediate region, forming the intermediate region with first and second axially spaced outwardly projecting retaining beads and with an outwardly projecting key formation between the beads, selecting a plastic locking ring of stiffly yieldable material and with a splined bore sized to non-destructively interfere with the bead which is nearer to the threaded portion, assembling and securing the attachment region of the neck part to the container-body part, selecting a threaded cap compatible with the neck threads and having one-way ratchet-locking engageability with a part of the ring, the direction of locking being in the unthreading direction, and axially assembling the ring over the threaded end of said neck part and into keyed detent retention between the beads by using the threaded advance of the cap to axially drive the ring into its keyed detent-retained position.

2. The method of claim 1, in which said container body part includes a top panel with a cylindrical flange struck up from an opening therein, the attachment means formed in the neck part being a cylindrical formation sized for telescopic overlap with the cylindrical flange, and in which the step of neck and body part assembly includes the step of circumferentially continuously soldering the region of telescopic overlap, the ring-assembly step being subsequent to assembly of the neck and body parts.

3. The method of making a self-locking safety closure for a metal container having a threaded neck to be closed by a threaded cap, which comprises selecting a threaded metal neck part and a metal container-body part to be assembled to each other, forming the neck part with threads at a region predominantly near the dispensing end and with radially enlarged means for attachment to the selected container-body part at a region near the other end, the thread region and the radially enlarged means being axially separated by an intermediate region, forming the intermediate region with an outwardly projecting retaining bead adjacent the threads and with an outwardly projecting key formation between the bead and the radially enlarged means, selecting a plastic locking ring of stiffly yieldable material and with a splined bore sized to nondestructively interfere with the bead, assembling and securing the attachment region of the neck part to the container-body part, selecting a threaded cap compatible with the neck threads and having one-way ratchet-locking engageability with a part of the ring, the direction of locking being in the unthreading direction, and then axially assembling the ring over the threaded end of the neck part and into keyed detent retention beneath the bead by using the threaded advance of the cap to axially drive the ring into its keyed detent-retained position.

4. The method of claim 3, in which the container body part is cylindrical with an upwardly open end, in which the radially enlarged portion of said neck part flares to the cylindrical diameter of the body part, and in which the step of neck and body part assembly includes the step of circumferentially continuously chime-connecting the frusto-conical base to the upwardly open end of the body part.

5. The method of making a self-locking safety closure for a dispensing container having a threaded neck to be closed by a threaded cap, which comprises selecting a container having a body and a reduced neck part with threads at a region predominantly near the dispensing end and with an outwardly projecting retaining bead beneath the threads and axially spaced from the body by an intermediate region, the intermediate region having an outwardly projecting key formation between the bead and the body, selecting a stiffly yieldable plastic locking ring with a splined bore sized to fit between the bead and the body and to non-destructively interfere with the bead, selecting a threaded cap compatible with the neck threads and having one-way ratchet-locking engeageability with a part of the ring, the direction of locking being in the unthreading direction, and axially assembling the ring over the threaded end of the neck part and into keyed detent retention between the bead and the body by using the threaded advance of the cap to axially drive the ring into its keyed detent-retained position.

* * * * *